US006769554B1

(12) United States Patent
Udofiah

(10) Patent No.: US 6,769,554 B1
(45) Date of Patent: Aug. 3, 2004

(54) HAIR CARE APPLIANCE HOLDER

(76) Inventor: Elizabeth S. Udofiah, 3121 Woodhill Dr., Tallahassee, FL (US) 32303

( * ) Notice: Subject to any disclaimer, the term of this patent is extended or adjusted under 35 U.S.C. 154(b) by 0 days.

(21) Appl. No.: 10/376,423

(22) Filed: Mar. 3, 2003

(51) Int. Cl.[7] ..... A47F 7/00
(52) U.S. Cl. ..... 211/70.6; 211/85.3; 211/26.2
(58) Field of Search ..... 211/70.6, 26, 26.2, 211/85.3; D28/73, 38; D6/524, 527

(56) References Cited

U.S. PATENT DOCUMENTS

| | | | | | |
|---|---|---|---|---|---|
| D246,913 | S | | 1/1978 | Kahn et al. | |
| 4,159,773 | A | | 7/1979 | Losenno | |
| D266,195 | S | | 9/1982 | Bennett | |
| 4,446,972 | A | * | 5/1984 | Sussman | 211/26 |
| D285,369 | S | | 8/1986 | Sussman | |
| D294,530 | S | | 3/1988 | Carluccio et al. | |
| D313,341 | S | | 1/1991 | Gaboriault et al. | |
| D335,935 | S | | 5/1993 | Rouail | |
| D347,538 | S | * | 6/1994 | Fleischer | D6/567 |
| 5,379,903 | A | * | 1/1995 | Smith | 211/26 |
| 5,485,931 | A | * | 1/1996 | Barr, Jr. | 211/70.6 |
| D372,189 | S | | 7/1996 | Andis et al. | |
| 5,547,393 | A | * | 8/1996 | Jansen | 439/501 |
| D374,312 | S | | 10/1996 | Edgar | |
| 5,727,701 | A | * | 3/1998 | Rhoades | 211/70.6 |
| 5,743,415 | A | | 4/1998 | Smart | |
| 5,794,799 | A | * | 8/1998 | Collins et al. | 211/70.6 |
| 5,875,794 | A | * | 3/1999 | Ekman | 206/373 |
| 5,917,694 | A | * | 6/1999 | Denny | 211/70.6 |
| D414,001 | S | | 9/1999 | Crotte et al. | |
| 6,003,804 | A | | 12/1999 | Vara | |
| D427,726 | S | | 7/2000 | Cruz et al. | |
| D430,857 | S | * | 9/2000 | Solomon | D13/199 |
| 6,305,388 | B1 | * | 10/2001 | Zeller | 132/314 |
| D454,460 | S | * | 3/2002 | Davies | D6/566 |

* cited by examiner

*Primary Examiner*—Daniel P. Stodola
*Assistant Examiner*—Erica B Harris
(74) *Attorney, Agent, or Firm*—Peter Loffler

(57) ABSTRACT

A hair care appliance holder holds multiple hair dryers and curling irons in an orderly fashion. A base member has a plurality of openings, each opening receiving one of the appliances. A cord storage mechanism is associated with each of the openings for holding the electrical cord of the appliance being held within the opening. Each opening has a socket associated with it such that the plug of the appliance's electrical cord is received within the socket in order to establish electrical communication between the appliance and a source of electrical power.

8 Claims, 3 Drawing Sheets

HAIR CARE APPLIANCE HOLDER

BACKGROUND OF THE INVENTION

1. Field of the Invention

The present invention relates to a holder that stores hair care appliances in an orderly fashion.

2. Background of the Prior Art

Hair dryers and curling irons are staples in every woman's ensemble. These two appliances, which receive daily attention, are found in every female's bathroom, young and old, as well as in hotel rooms and hair salons. The problem encountered by users of these devices rests in the storage of the devices. Both the hair dryer and the curling iron require heat during use. As the heat generated by such devices can reach very high levels, these devices cannot be placed just anywhere immediately after use. The high heat developed by the devices can pose a hazard to people in the usage area who may inadvertently come in contact with one of the devices, and in some circumstances, the hot devices may pose a fire hazard.

Additionally, the storage of these devices, even after cooling down appropriately, poses some logistical problems. Either the devices are simply laid on the bathroom counter wherein they pose as an obstacle for other functions to be performed, or the devices are placed into a drawer or cabinet where they can become entangled with each other as well as with other appliances being stored by the user.

In a household where more than one female lives and shares the same bathroom, the problems with hair dryer and curling iron storage are multiplied, due to the fact that while one hair dryer may suffice for all to share, each person requires her own curling iron. Multiple curling irons and one or more hair dryers jockeying for limited real estate is no small problem.

Therefore, there exists a need in the art for a device that will accommodate efficient holding and storage of multiple hair care accessories. Such a device must minimize the potential for a person to become burned due to inadvertent contact with the appliance after usage of the appliance. The potential for fire must be virtually eliminated by the use of such a storage device. The device must permit storage of the hair care appliances without undue impact on the available bathroom counter real estate and must avoid the potential for the cords of the hair care appliances to become entangled with one another and with other items stored by the users of the appliances. Ideally, such a device will be of relatively simple and straightforward design and construction and will be easy to use and maintain.

SUMMARY OF THE INVENTION

The hair care appliance holder of the present invention addresses the aforementioned needs in the art. The hair care appliance holder accommodates efficient holding and storage of multiple hair care accessories such as hair dryers and curling irons. The device minimizes the potential for a person to become burned due to inadvertent contact with one of the appliances being held by the device after usage of the appliance. The potential for fire is virtually eliminated by the use of the hair care appliance holder. The hair care appliance holder of the present invention permits storage of the hair care appliances without undue impact on the available bathroom counter real estate and greatly minimizes the potential for the cords of the hair care appliances being stored by the device to become entangled with one another and with other items stored by the users of the appliances. The hair care appliance holder is of relatively simple and straightforward design and construction and is easy to use and maintain.

The hair care appliance holder of the present invention is comprised of a base member that has a top surface and a bottom surface. A plurality of openings are located on the base member. At least one cord storage mechanism holds an electrical cord thereon, the cord storage mechanism being attached to the upper surface of the base member and each is associated with a respective one of the plurality of openings. At least one electrical socket is provided and each socket is connected to a source of electrical power and is secured to the base member and each is associated with a respective one of the openings. Each of the openings receives a hair care appliance, such as a hair dryer or curling iron, such that the electrical cord of each appliance is stored above the respective cord storage mechanism associated with the respective opening within which the appliance is stored, and a plug terminating the electrical cord of the respective appliance is received within the electrical socket associated with the respective opening for electrically powering the appliance. The base member has a flange such that the flange may be used to attach the storage device to a wall. Some or all of the electrical sockets may be located on the flange. Each cord storage mechanism may be comprised of a stanchion that extends upwardly from the top surface of the base member and a pair of hooks, each having an opening, the pair of hooks being attached to the stanchion such that the openings on each of the pair of hooks are oriented in opposing fashion with the lower hook generally facing the base member and the upper hook generally facing upwardly away from the base member. Some of the plurality of openings are of a different size relative to others of the plurality of openings for holding appliances of different sizes.

BRIEF DESCRIPTION OF THE DRAWINGS

Similar reference numerals refer to similar parts throughout the several views of the drawings.

DESCRIPTION OF THE PREFERRED EMBODIMENT

Figure 1:
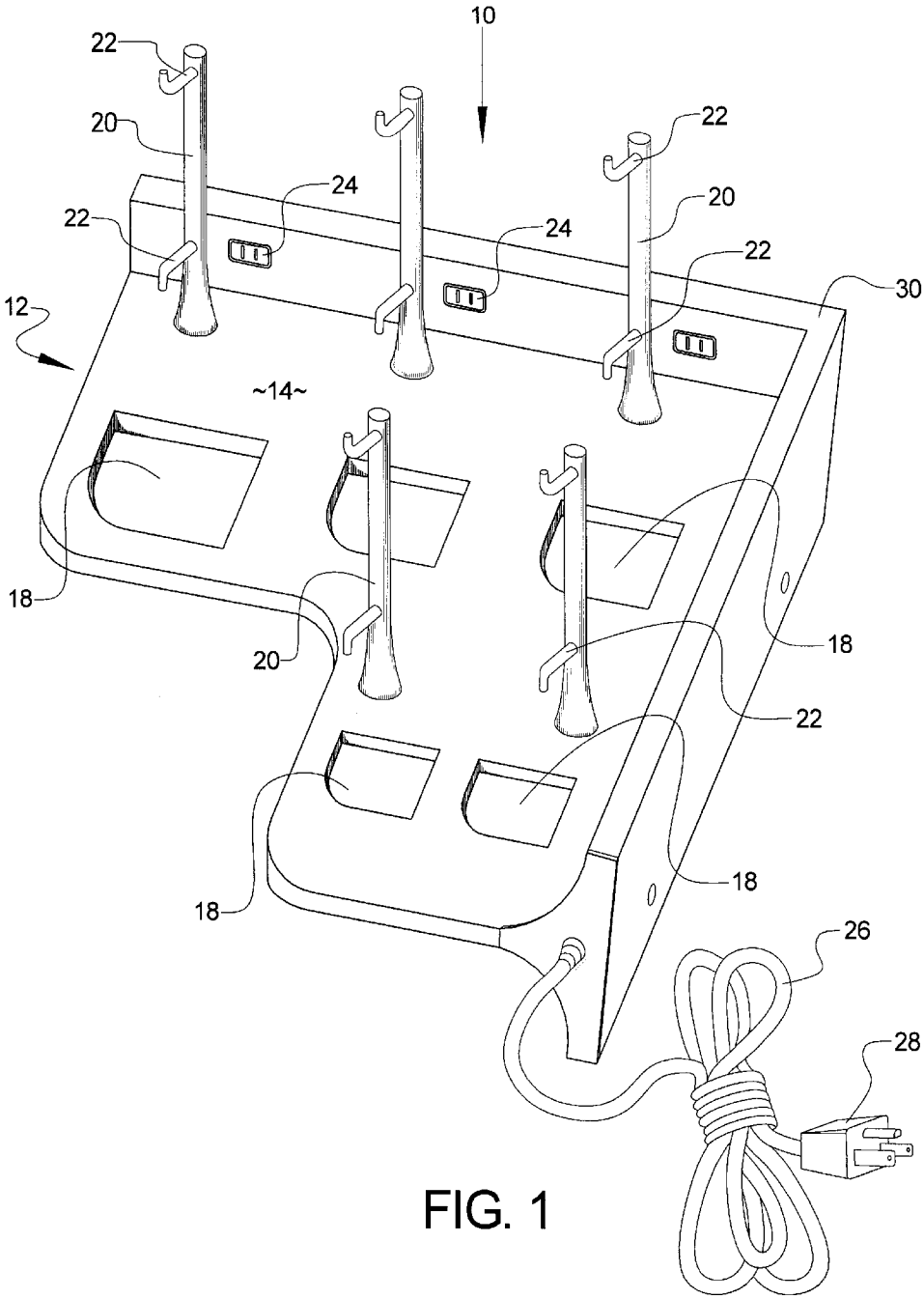
FIG. 1 is a perspective view of the hair care appliance holder of the present invention.
Figure 2:
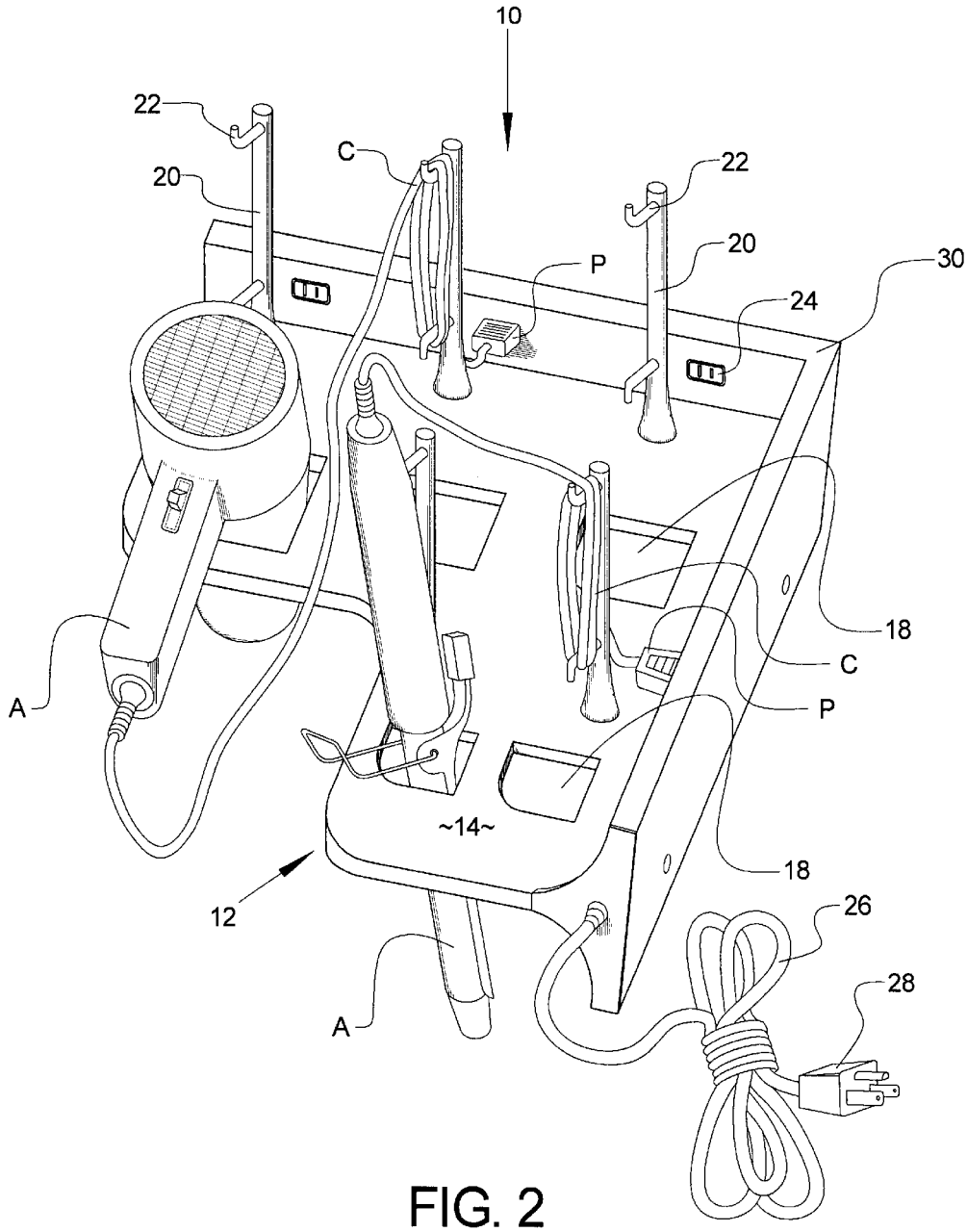
FIG. 2 is an environmental view of the hair care appliance holder of the present invention holding hair care appliances.
Figure 3:
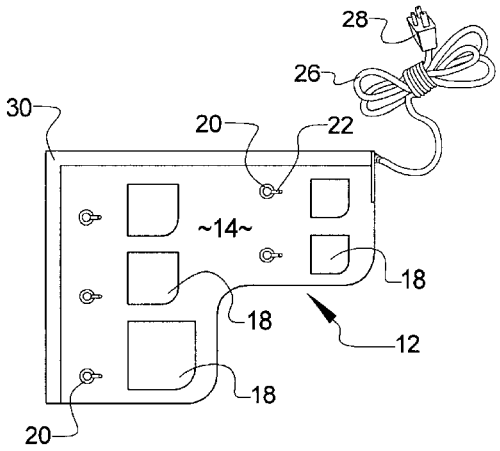
FIG. 3 is a top plan view of the hair care appliance holder.
Figure 4:
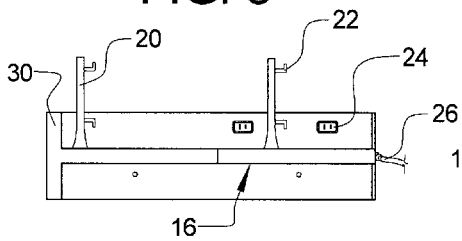
FIG. 4 is a front elevation view of the hair care appliance holder.
Figure 5:
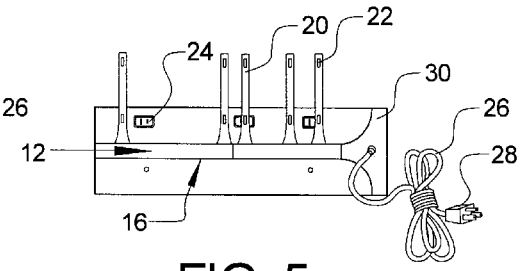
FIG. 5 is a right side elevation view of the hair care appliance holder.
Figure 6:
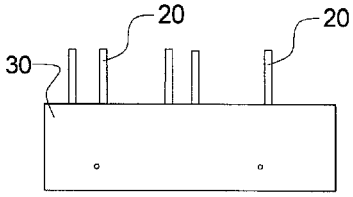
FIG. 6 is a left side elevation view of the hair care appliance holder.
Figure 7:
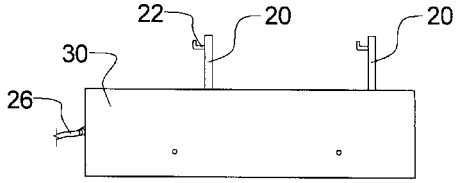
FIG. 7 is a rear elevation view of the hair care appliance holder.

Referring now to the drawings, it is seen that the hair care appliance holder of the present invention, generally denoted by reference numeral 10, is comprised of a base member 12 having a top surface 14 and a bottom surface 16. A plurality of openings 18 are located on the base member 12. At least one cord storage mechanism holds an electrical cord C of an appliance A thereat, the cord storage mechanism being attached to the upper surface 14 of the base member 12. One cord storage mechanism is associated with each of the plurality of openings 18. Each cord storage mechanism may be comprised of a stanchion 20 that extends upwardly from the top surface 14 of the base member 12 and a pair of hooks 22, each hook 22 having an opening, the pair of hooks 22 being attached to the stanchion 20 such that the openings on each of the pair of hooks 22 are oriented in opposing fashion with the lower hook 22 facing generally toward the base member 12 and the upper hook 22 facing upwardly generally away from the base member 12. Each opening 18 may have a separate stanchion 20 and hook 22 pair arrangement, or a single stanchion 20 may hold two or more hook 22 pairs, each hook pair 22 being associated with a respective one of the openings 18 for holding the electrical cord C of the appliance A being held within that particular opening 18.

At least one electrical socket 24 is provided and each is connected to a source of electrical power and is secured to the base member 12 and each is associated with a respective one of the openings 18. Each electrical socket 24 is a standard electrical socket 24 that receives a plug P from an electrical cord C of an appliance A being held by the device 10. The various electrical sockets 24 located about the base member 12 are each electrically connected, advantageously in parallel, to a secondary electrical cord 26 and plug 28 which plug 28 is receivable within a standard electrical outlet (not illustrated) in order to electrically couple each of the electrical sockets 24 to a source of electrical power. If desired, the electrical system, due to its proximity to a source of water, may have appropriate ground fault interrupt circuitry (not illustrated) built therein for protection against electrical shock. The base member 12 may have a flange 30 such that the flange 30 is used to attach the hair care appliance holder 10 to a wall. Some or all of the electrical sockets 24 may be located on this flange 30.

In order to use the hair care appliance holder 10 of the present invention, the base member 12 is attached to a wall in any standard fashion. This may be accomplished by passing appropriate screws through the flange 30 of the base member 12 into the wall, by providing appropriate brackets. (not illustrated) attached to the bottom surface 16 of the base member 12 and attaching the brackets to the wall, or by any other well established method of attachment. It is noted that the base member 12 may have any desired shape including a rectangular or semicircular shape for attachment to a straight portion of the wall, the illustrated generally L-shape or a triangular shape for attachment within a wall corner, or any other shape appropriate for the particular application.

Once the base member 12 is attached to the wall, its electrical plug 28 is secured to a wall outlet (not illustrated) in order to provide electrical power for each of the electrical sockets 24.

A hair care appliance A, such as a hair dryer or a curling iron is placed into a respective one of the openings 18. The electrical cord C of each appliance A is stored about the respective cord storage mechanism associated with the respective opening 18 within which the appliance A is stored such that the cord C is wrapped about the pair of hooks 22. The plug P terminating the electrical cord C of the respective appliance A is received within the electrical socket 24 associated with the respective opening 18, for electrically powering that appliance A. When use of a particular appliance A is desired, that appliance A is retrieved and its electrical cord C is unwound from the hooks 22 of the cord storage mechanism and the appliance A is used as desired. Once use of the appliance A is completed, the electrical cord C is rewound about the hooks 22 of the cord storage mechanism and the appliance A returned to its respective opening 18. Some of the plurality of openings 18 are of a different size relative to others of the plurality of openings 18 for holding appliances A of different sizes, such that one or more larger openings 18 can be used to hold hair dryers while one or more smaller openings 18 can be used to hold the relatively smaller curling irons.

While the invention has been particularly shown and described with reference to an embodiment thereof, it will be appreciated by those skilled in the art that various changes in form and detail may be made without departing from the spirit and scope of the invention.

I claim:

1. A storage device comprising:

a base member having a top surface and a bottom surface;

a plurality of openings disposed within the base member;

at least one cord storage mechanism adapted to hold an electrical cord, attached to the base member and each cord storage mechanism associated with a respective one of the plurality of openings each cord storage mechanism having a stanchion extending upwardly from the top surface of the base member and a pair of hooks attached to the stanchion such that the hooks open in opposing direction at least one electrical socket, each connected to a source of electrical power, secured to the base member and each of the at least one electrical socket associated with a respective one of the plurality of openings; and wherein each of the plurality of openings is adapted to receive a hair care appliance such that the electrical cord of the appliance is stored about the respective cord storage mechanism associated with the respective opening, and a plug secured to the electrical cord of the respective appliance is received within the electrical socket associated with the respective openings.

2. The storage device as in claim 1 wherein the base member has a flange such that the flange is used to attach the base member to a wall.

3. The storage device as in claim 2 wherein at least one of the at least one electrical socket is located on the flange.

4. The storage device as in claim 1 wherein some of the plurality of openings are of a different size relative to others of the plurality of openings.

5. A storage device comprising:

a base member having a top surface and a bottom surface;

a plurality of openings disposed within the base member;

at least one cord storage mechanism adapted to hold an electrical cord, attached to the base member and each cord storage mechanism associated with a respective one of the plurality of openings each cord storage mechanism having a stanchion extending upwardly from the top surface of the base member and a pair of hooks attached to the stanchion such that the hook that is closer to the base member opens toward the base member and the other hook opens in opposing fashion at least one electrical socket, each connected to a source of electrical power, secured to the base member and each of the at least one electrical socket associated with a respective one of the plurality of openings; and wherein each of the plurality of openings is adapted to receive a hair care appliance such that the electrical cord of the appliance is stored about the respective cord storage mechanism associated with the respective opening, and a plug secured to the electrical cord of the respective appliance is received within the electrical socket associated with the respective openings.

6. The storage device as in claim 5 wherein the base member has a flange such that the flange is used to attach the base member to a wall.

7. The storage device as in claim 6 wherein at least one of the at least one electrical socket is located on the flange.

8. The storage device as in claim 5 wherein some of the plurality of openings are of a different size relative to others of the plurality of openings.

* * * * *